US007021850B1

(12) United States Patent
Lee

(10) Patent No.: US 7,021,850 B1
(45) Date of Patent: Apr. 4, 2006

(54) FIVE-SURFACE CLEANING BRUSH

(76) Inventor: Ching-Hsuan Lee, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/039,713

(22) Filed: Jan. 21, 2005

(51) Int. Cl.
*A46B 11/04* (2006.01)

(52) U.S. Cl. ..... 401/291; 401/282; 401/286; 401/289; 401/284; 15/167.1

(58) Field of Classification Search ..... 401/282–291; 15/167.1, 172
See application file for complete search history.

(56) References Cited

U.S. PATENT DOCUMENTS 5,137,039 A * 8/1992 Klinkhammer ..... 15/167.1

5,746,595 A * 5/1998 Ford ..... 401/289

* cited by examiner

*Primary Examiner*—Khoa D. Huynh

(57) ABSTRACT

A five-surface cleaning brush comprises a seat having a top surface, a front surface, an inclined surface connected the top surface and the front surface; and two lateral surfaces; and a plurality of hair beams which are formed on the top surface, front surface, inclined surface and two lateral surfaces of the seat; the hair beams being formed with a five hair surfaces. A first hair surface is formed on the top surface. A second hair surface is formed on the front surface. A third hair surface is formed on the inclined surface. The fourth and fifth hair surfaces are formed on the two lateral surfaces. The first hair surface is inclined to the third hair surfaces with a first inclined angle and the second hair surface is inclined to the third hair surface with a second inclined angle.

4 Claims, 8 Drawing Sheets

FIVE-SURFACE CLEANING BRUSH

FIELD OF THE INVENTION

The present invention relates to brushes, and in particular to a five-surface cleaning brush, wherein the brush has five hair surfaces, so that undesired objects in the dead points can be cleaned completely. Cleaning liquid flows out from a plurality of water outlets which are uniformly distributed on a brush surface so as to have a high efficiency cleaning effect.

BACKGROUND OF THE INVENTION

Referring to FIG. 1, a general cleaning brush for cleaning a car or a large scale machine is illustrated. An upper surface 91 of a seat 90 is planted with hair beams 92 so as form a cambered hair surface 93. The seat 90 has a connecting opening 901 capable of being connected to a clean liquid tube. The connecting opening is communicated to the two water outlets 902 in the seat surface 91 (referring to FIG. 2) so that the cleaning liquid flows to the hair surface 93 along the hair beams 92 through the water outlets 902.

Obviously, the prior art has some defects, for example, only the surface 92 of the seat is planted with hairs so that only one hair surface 93 is formed. Thereby some dead points in a cleaning object to be cleaned, such as bending portions, cannot be cleaned completely so that cleaning efficiency is low.

Furthermore, the prior art connecting opening 902 is formed in a middle section of the seat 90, as shown in FIG. 2, so that the water outlets are formed on a center position of the surface 91. As a result, two sides of the hair surface have no cleaning liquid so that the cleaning operation cannot be performed uniformly on the hair surface.

SUMMARY OF THE INVENTION

Accordingly, the primary object of the present invention is to provide a five-surface cleaning brush, wherein the brush has five hair surfaces, so that undesired objects in the dead points can be cleaned completely.

Another object of the present invention is to provide a five-surface cleaning brush, wherein cleaning liquid flows out from a plurality of water outlets which are uniformly distributed on a brush surface so as to have a high efficiency cleaning effect.

A further object of the present invention is to provide a five-surface cleaning brush, wherein in the manufacturing process, two sides of the transversal tube are sealed by the water outlets. When the seat is formed, the transversal tube is formed from the lateral surfaces. The water outlets are formed from the inclined surface. Then the water-stop plugs serve to seal two sides of the transversal tube. Then the top surface, inclined surface, front surface, and two lateral surfaces are planted with hair beams so as to form a five-surface cleaning brush. Then the hair beams are ordered to have radiated brush hairs.

A yet object of the present invention is to provide a five-surface clearing brush, wherein the two lateral surfaces of the seat can be enlarged. Other than being implanted with fourth and fifth hair surfaces and, it can enhance the structural strength of the five-surface cleaning brush so as to increase the lifetime of the brush.

To achieve above object, The present invention provide a five-surface cleaning brush which comprises a seat having a top surface, a front surface, an inclined surface connected the top surface and the front surface; and two lateral surfaces; and a plurality of hair beams which are formed on the top surface, front surface, inclined surface and two lateral surfaces of the seat; the hair beams being formed with a five hair surfaces. A first hair surface is formed on the top surface. A second hair surface is formed on the front surface. A third hair surface is formed on the inclined surface. The fourth and fifth hair surfaces are formed on the two lateral surfaces. The first hair surface is inclined to the third hair surfaces with a first inclined angle and the second hair surface is inclined to the third hair surface with a second inclined angle.

The various objects and advantages of the present invention will be more readily understood from the following detailed description when read in conjunction with the appended drawing.

DETAILED DESCRIPTION OF THE INVENTION

Figure 1:
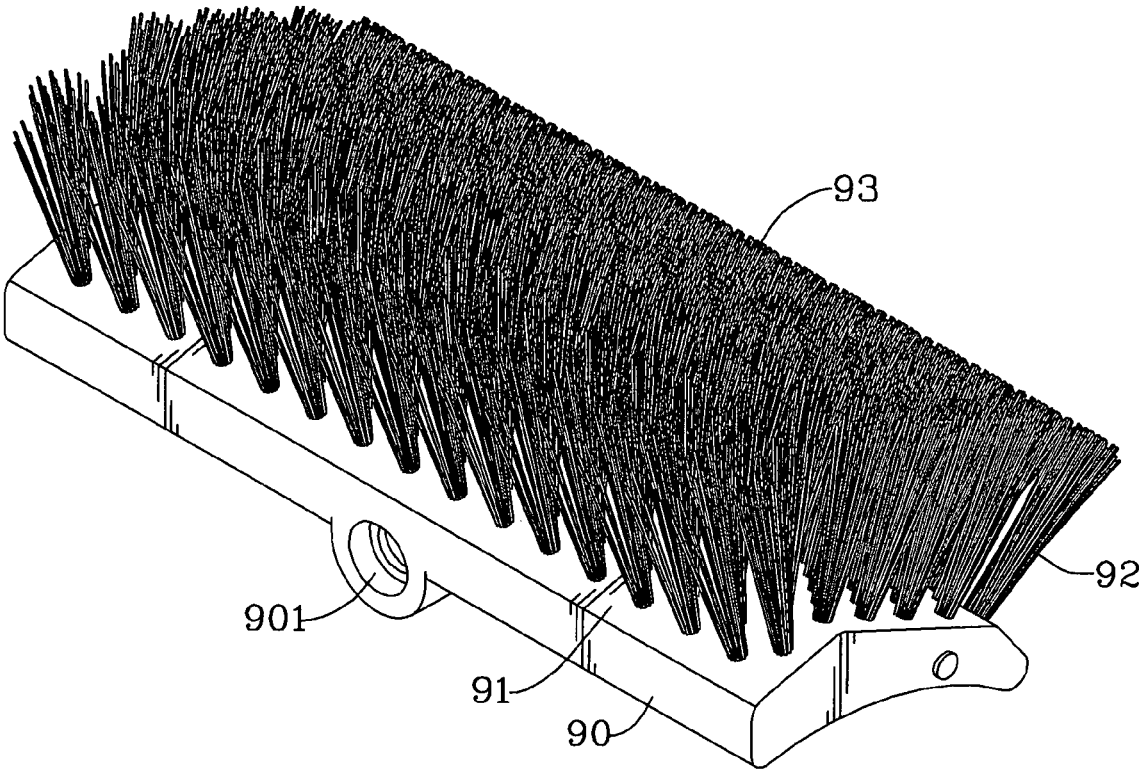
Fig. 1 (PRIOR ART)
FIG. 1 shows a prior art cleaning liquid.
Figure 2:
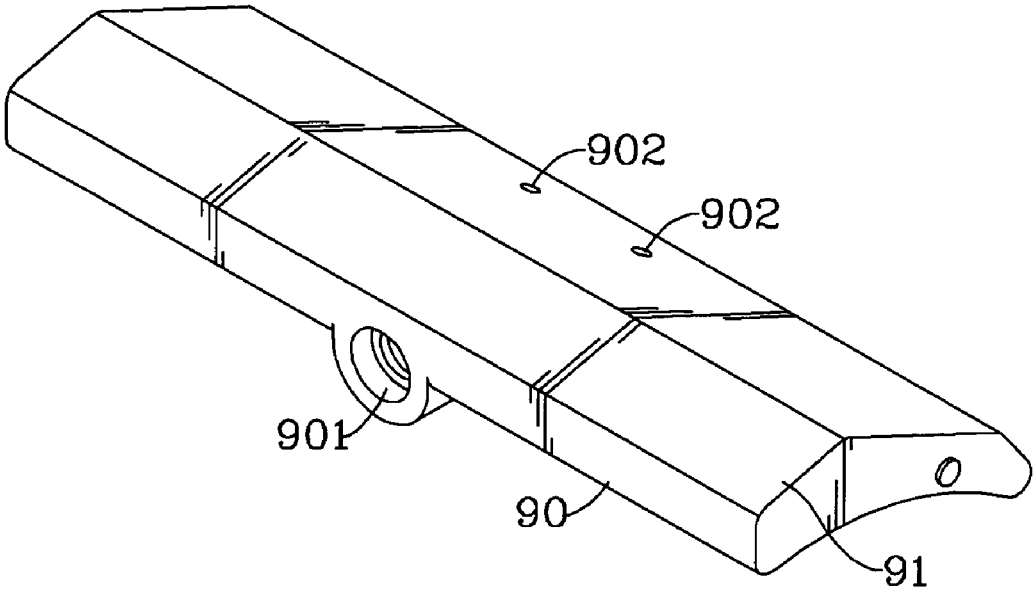
Fig. 2 (PRIOR ART)
FIG. 2 is a seat of a prior art cleaning brush.
Figure 3:
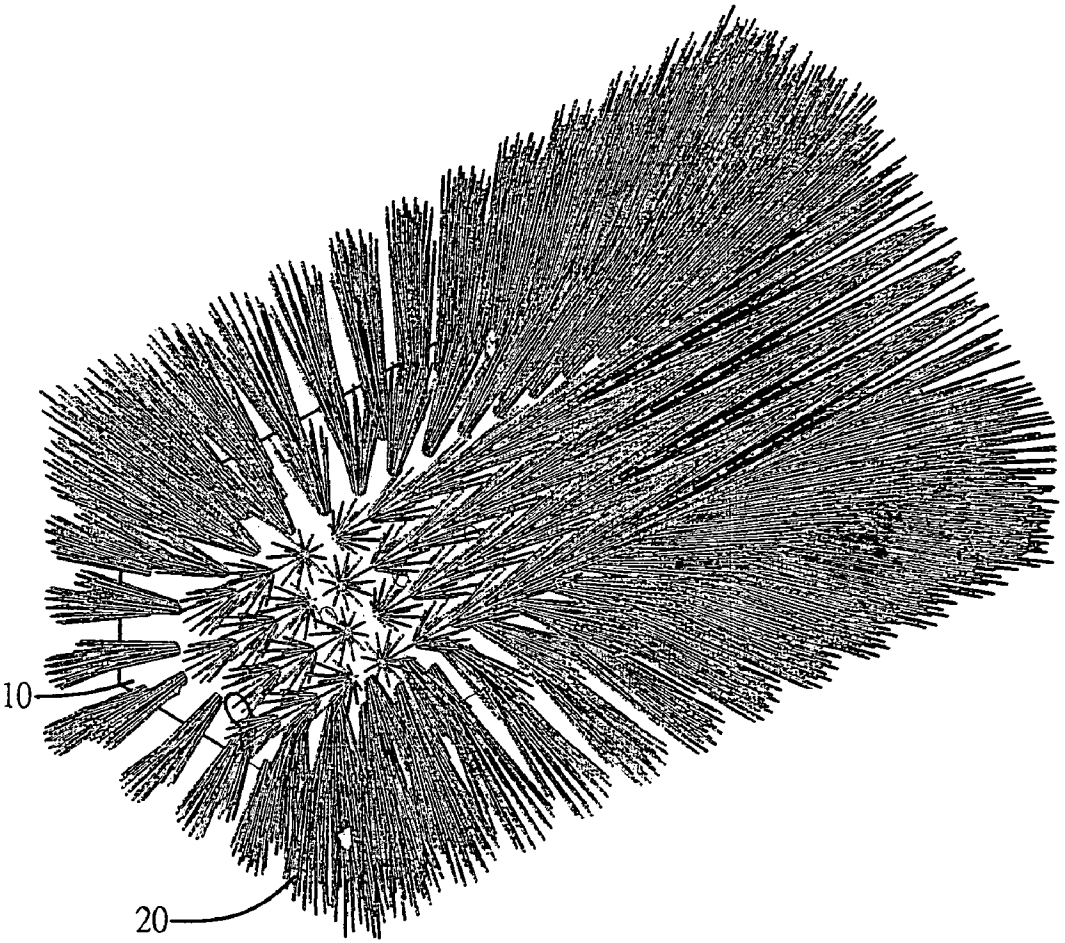
FIG. 3 shows the cleaning brush of the present invention
Figure 4:
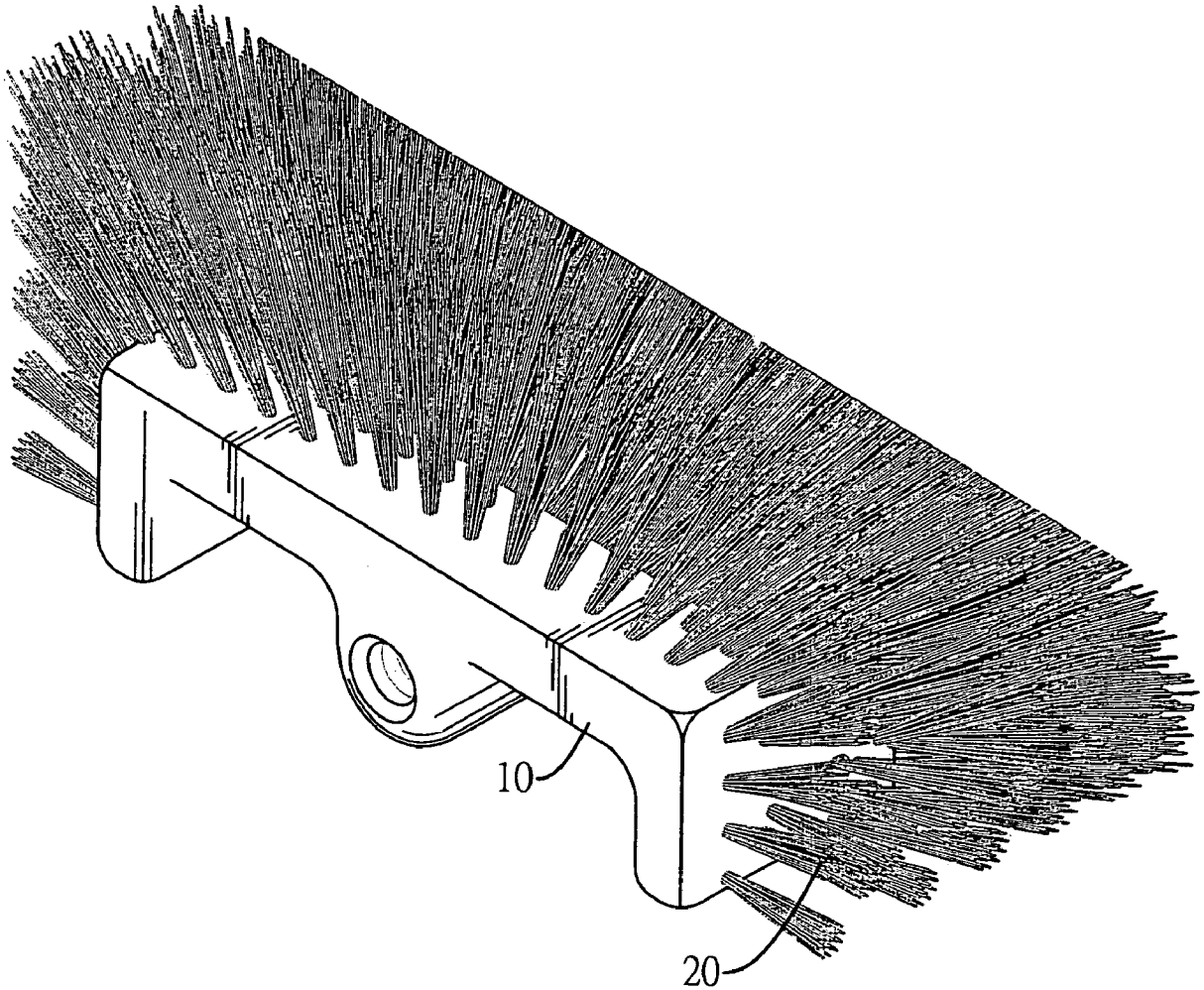
FIG. 4 is perspective view of FIG. 3 which is viewed from another orientation.
Figure 5:
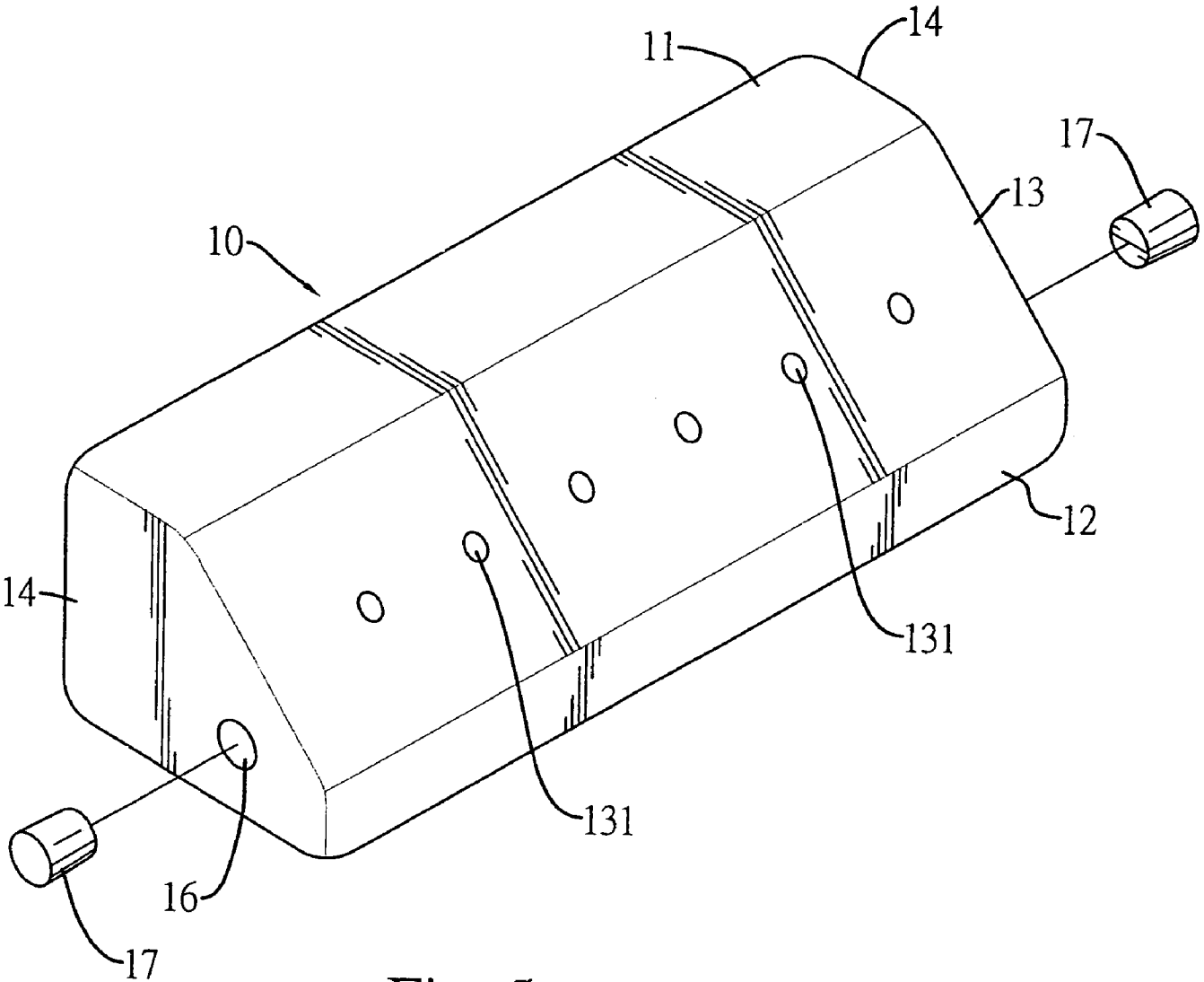
FIG. 5 shows the seat of FIG. 3.

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

With reference to FIGS. 3 to 6, the five-surface cleaning brush of the present invention is illustrated. The present invention has the following elements.

A seat 10 is a long strip. The seat 10 has a top surface 11, a front surface 12 and an inclined surface 13 connected the top surface 11 and the front surface 12. The inclined surface 13 is inclined to the top surface 11 with an angle of 45 degrees. Two sides of the seat 10 are two symmetrical lateral surfaces 14.

Figure 6:
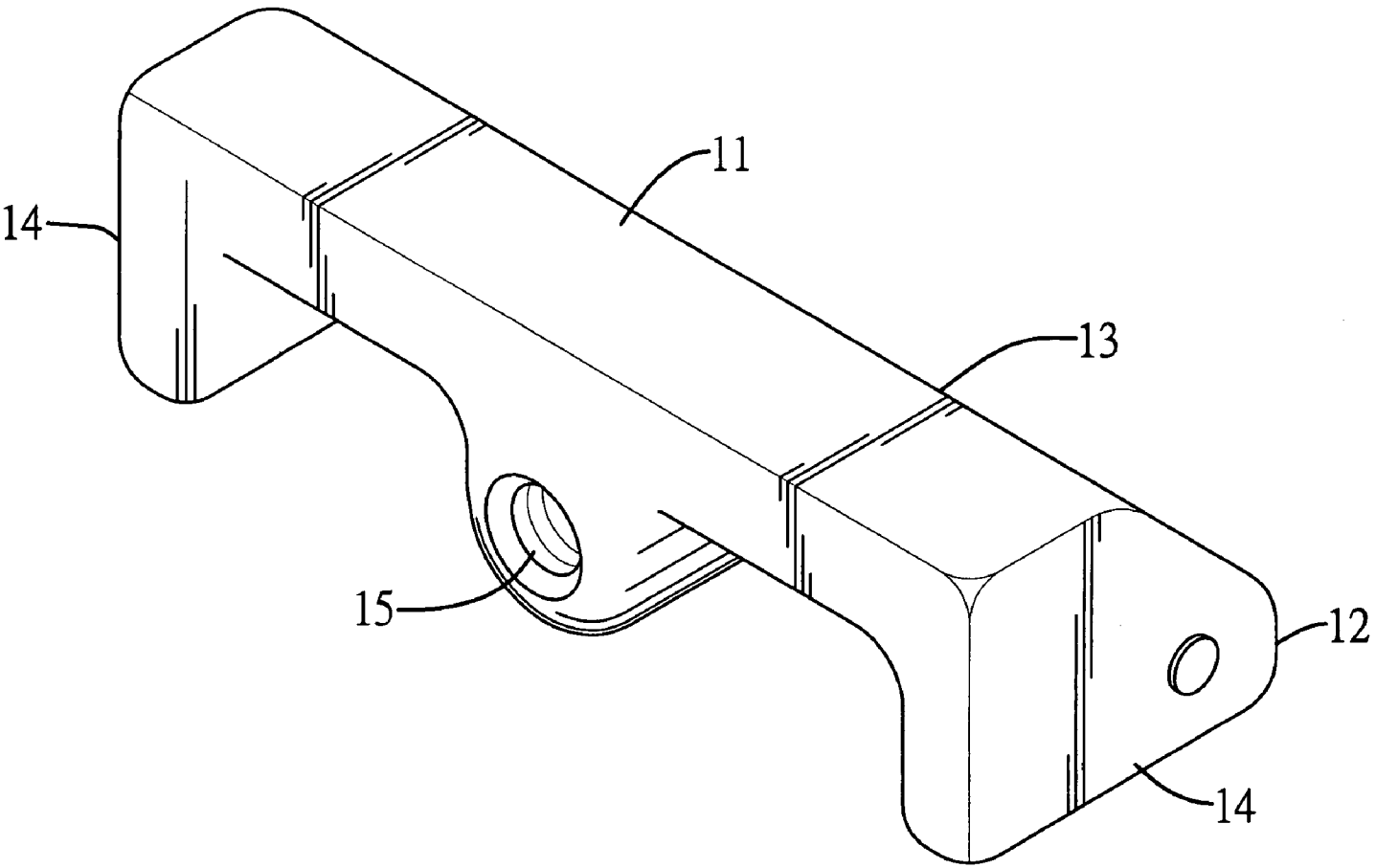
FIG. 6 is a view of FIG. 5 which is viewed from another orientation.

A plurality of water outlets 131 spaced with an equal space are formed on the inclined surface 13. In FIG. 6, there are six water outlets 131 are illustrated. However the number of the water outlets 131 is changeable according to the viscosity of the cleaning liquid and length of the seat 10.

A transversal tube 16 penetrates the two lateral surfaces 14 of the seat 10. Two ends of the transversal tube 16 are sealed by water-stop plugs 17.

Referring to FIG. 6, a center of a back of the seat 10 has a connecting opening 15 which is communicated to a cleaning liquid tube. The connecting opening 15 is further communicated to the transversal tube 16 in the seat 10.

In the manufacturing process, two sides of the transversal tube 16 are sealed by the water outlets 131. When the seat 10 is formed. The transversal tube 16 is formed from the lateral surfaces 14. The water outlets 131 are formed from the inclined surface 13. Then the water-stop plugs 17 serve to seal two sides of the transversal tube 16. Then the top surface 11, inclined surface 13, front surface 12, and two lateral surfaces 14 are planted with hair beams 20 so as to form a five-surface cleaning brush. Then the hair beams 20 are ordered to have radiated brush hairs.

Figure 7:
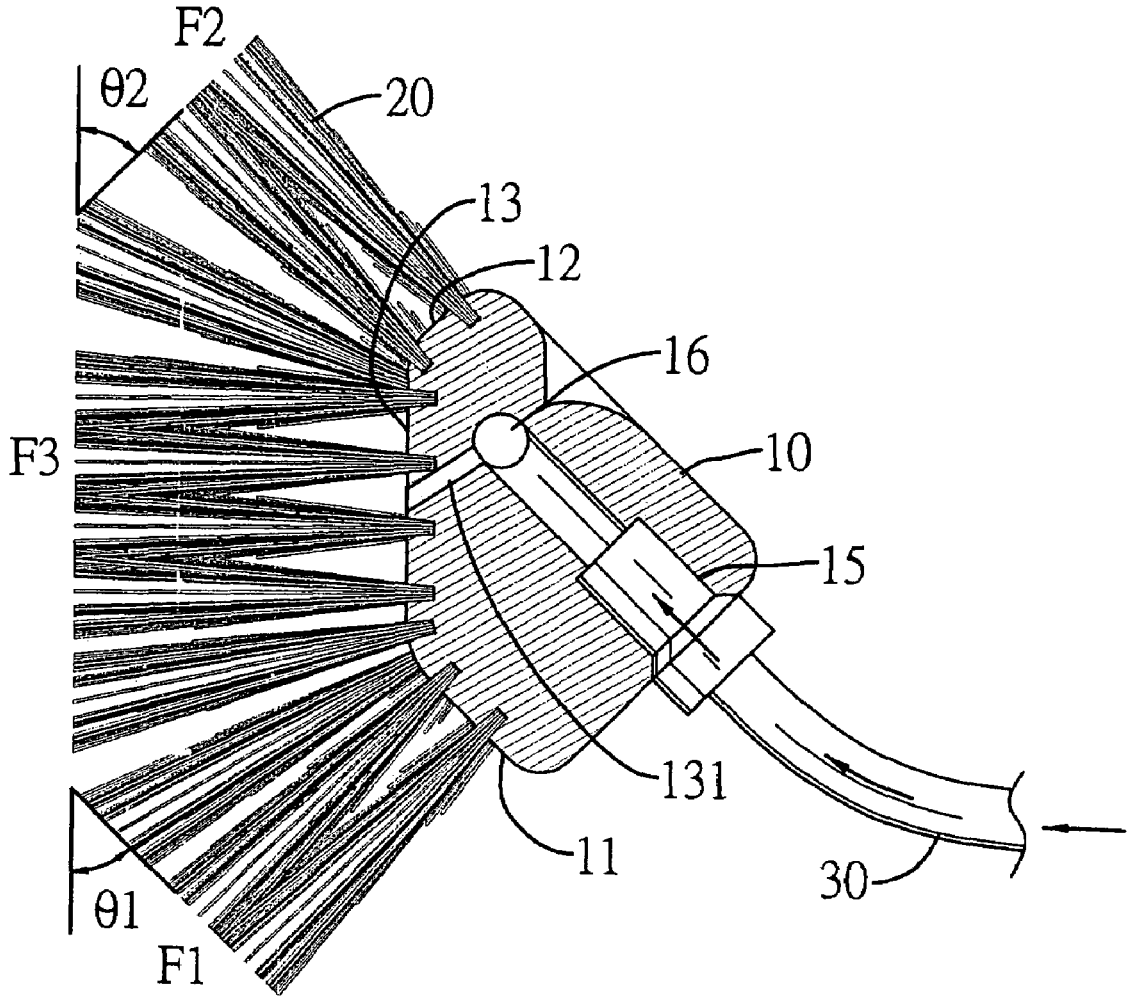
FIG. 7 is a lateral cross sectional view of FIG. 3.
Figure 8:
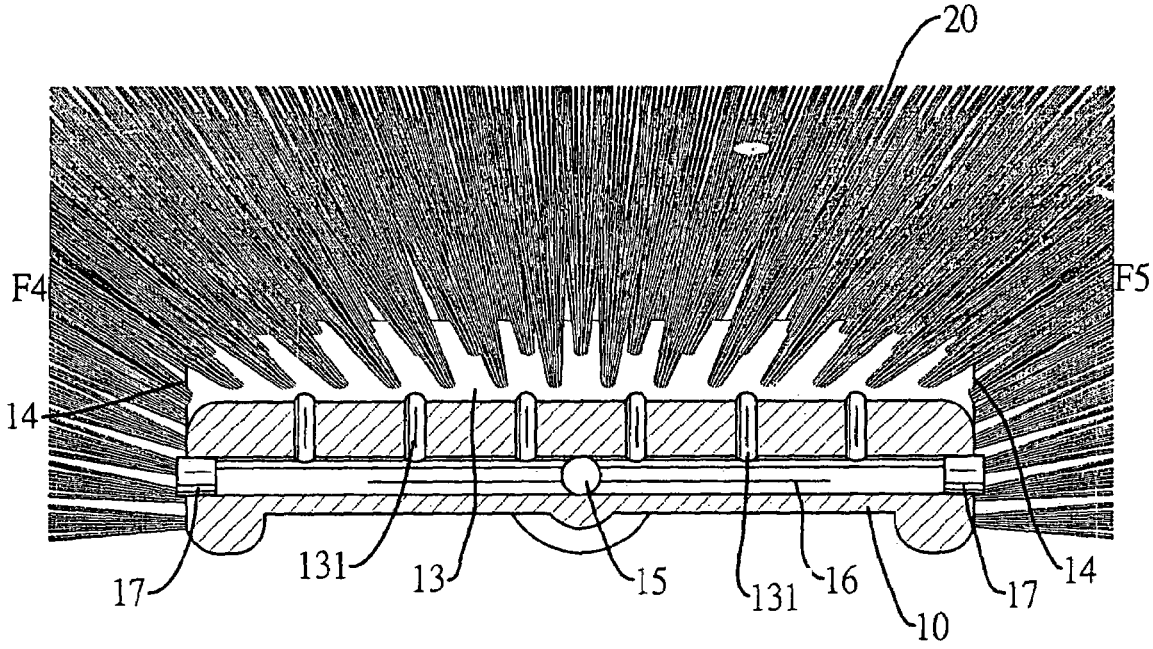
FIG. 8 is a top cross sectional view of FIG. 3.

The communications of the water outlets 131, transversal tube 16 and connecting opening 15 are illustrated in FIGS. 7 and 8.

The main design of the present invention is illustrated in FIGS. 7 and 8. The top surface 11, inclined surface 13, front surface 12 and two lateral surfaces 14 are planted with hair beams 20. The top surface 11 is formed with a first hair surface F1. The front surface 12 is formed with a second hair surface F2. The inclined surface 13 is formed with a third hair surface F3 (see FIG. 7). The two lateral surfaces 14 are formed with fourth hair surface F4 and fifth hair surface F5 (referring to FIG. 8).

Referring to FIG. 7, an angle θ1 is formed between the first hair surface F1 and second hair surface F2. An angle θ2 is formed between the second hair surface F2 and third hair surface F3. In this the present invention, the angle θ1 and angle θ2 are 45 degrees. However the inclined angle is not confined to this value. It can be adjustable as desired. The angle θ1 can be unequal to the angle θ2.

Thereby the present invention has five different hair surfaces. It is preferred than the prior art which has only one hair surface, specifically when an object to be cleaned has a plurality of surfaces with different orientations. Thereby the present invention provides a preferred cleaning effect.

Referring to FIG. 7, in use of the present invention, the connecting opening 15 of the present invention is connected to the cleaning liquid tube 30. The cleaning liquid will flow along the direction as illustrated in the arrow is uniformly transferred to the plurality of water outlets 131 on the inclined surface 13. Then the liquid flows to the hair surfaces along the hair beams 20 so as to improve the prior art problem in that the cleaning liquid is not uniformly distributed on the hair surfaces.

Furthermore, in the present invention, the two lateral surfaces 14 of the seat 10 can be enlarged. Other than being implanted with fourth and fifth hair surfaces F4 and F5, it can enhance the structural strength of the five-surface cleaning brush so as to increase the lifetime of the brush.

Each of the two lateral surfaces 13 is connected to the top surface 11, the front surface 12, and the inclined surface 13. The top surface 11, the front surface 12, the inclined surface 13 and the two lateral surfaces 14 are enclosed as a groove. The outer surfaces of the top surface 11, front surface 12, inclined surface 13 and the two lateral surfaces 14 are defined as the surfaces at an outer sides of the groove. The first, second, third, fourth and fifth hairs protrude from the outer surfaces of the top surface 11, the front surface 12, the inclined surface 13 and the two lateral surfaces 14, respectively.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A five-surface cleaning brush comprising:

a seat having a top surface, a front surface, an inclined surface between the top surface and the front surface; and two lateral surfaces; and a plurality of hair beams formed on the top surface, front surface, inclined surface and two lateral surfaces of the seat; the hair beams being formed with five hair surfaces, a first hair surface being formed on the top surface, a second hair surface being formed on the front surface; a third hair surface being formed on the inclined surface; and fourth and fifth hair surfaces being formed on the two lateral surfaces; wherein the first hair surface is inclined to the third hair surfaces with a first inclined angle and the second hair surface is inclined to the third hair surface with a second inclined angle;

wherein each of the two lateral surfaces is connected to the top surface, the front surface, and the inclined surface;

wherein the top surface, front surface, inclined surface and the two lateral surfaces are enclosed as a groove;

wherein outer surfaces of the top surface, front surface, inclined surface and two lateral surfaces are defined as the surfaces at an outer sides of the groove;

wherein the first, second, third, fourth and fifth hairs protrude from the outer surfaces of the top surface, the front surface, the inclined surface and the two lateral surfaces, respectively; and no hair protruded from inner surfaces of the groove formed by the top surface, the front surface, the inclined surface and the two lateral surfaces;

wherein an inclined surface of the seat is formed with a plurality of water outlets which are spaced with an equal distance; a transversal tube penetrates through the two lateral surfaces; the transversal tube is communicated to a connecting opening connected to a clean liquid tube and is communicated to a back surface of the seat; thus clean liquid flows through the connecting opening and the transversal tube to flow out from the water outlets.

2. The five-surface cleaning brush as claimed in claim 1, wherein two end openings of the transversal tube are sealed by water-stop plugs.

3. The five-surface cleaning brush as claimed in claim 1, wherein the inclined surface is inclined to the top surface and front surface with an angle of 45 degrees.

4. The five-surface cleaning brush as claimed in claim 1, wherein the first and second inclined angles are about 45 degrees.

* * * * *